US006013906A

United States Patent [19]

Kim

[11] Patent Number: 6,013,906

[45] Date of Patent: Jan. 11, 2000

[54] OPERATING CONDITION SETTING TYPE MICROWAVE OVEN

[75] Inventor: You-Ho Kim, Incheon, Rep. of Korea

[73] Assignee: Daewoo Electronic Co. Ltd., Seoul, Rep. of Korea

[21] Appl. No.: 09/079,201

[22] Filed: May 15, 1998

[30] Foreign Application Priority Data

Jun. 19, 1997 [KR] Rep. of Korea ..... 97-25636

[51] Int. Cl.[7] ..... H05B 6/66

[52] U.S. Cl. ..... 219/702; 219/708; 219/720

[58] Field of Search ..... 219/678, 702, 219/704, 705, 708, 710, 713, 715, 716, 717–723

[56] References Cited

U.S. PATENT DOCUMENTS 5,272,300 12/1993 Edamura ..... 219/723

5,369,252 11/1994 Kondo ..... 219/704

5,512,735 4/1996 Hashimoto ..... 219/723

5,530,230 6/1996 Smith et al. ..... 219/723

*Primary Examiner*—Tu Ba Hoang

*Attorney, Agent, or Firm*—Smith, Gambrell & Russell, LLP

[57] ABSTRACT

A frequency of input power is selected with a first keypad, and a weight unit is selected with a second keypad provided on a microwave oven. A displaying unit is connected with the key inputting devices and displays operating conditions of the microwave oven that are set by the first and second keypads. A controller detects the operating conditions by checking whether the displaying means and each of the first and second keypads form closed loops by applying control signals to the loops and sets the detected operating conditions as preset operating conditions of the microwave oven. Then, the controller controls the cooking operation of the microwave oven according to the preset conditions.

3 Claims, 3 Drawing Sheets

OPERATING CONDITION SETTING TYPE MICROWAVE OVEN

BACKGROUND OF THE INVENTION

1. Field of the Invention

The present invention relates to an operating condition setting-type microwave oven for which, while a membrane keypad corresponding to a control panel of the microwave oven is being manufactured, in order for a control section to execute a key scanning operation, a contact sheet for confirming a set operating condition of the microwave oven is formed in a predetermined key, so that a user can confirm information according to the set operating condition of the microwave oven, and to a method for setting and for detecting the operating condition thereof.

2. Description of the Prior Art

Generally, a microwave oven is a device which cooks food by using microwaves and is divided into a mechanical-type microwave oven and an electronic-type microwave oven.

The mechanical-type microwave oven operates in such a manner that a user optionally adjusts a cooking time and an output of the microwave through a timer knob and an output control knob in accordance with the food to be cooked, respectively. The electronic-type microwave oven operates in such a manner that after optionally selecting both a cooking menu and a cooking time, a user pushes a start key to manually cook the food or, an after a user selects a cooking menu and pushes a start key, a microcontroller performs a cooking operation according to a cooking menu for a set cooking time.

In the case of the electronic-type microwave oven, the microcontroller automatically performs the cooking operation according to the cooking menu, and interfaces the microcontroller to the user by installing a plurality of keys for selecting the cooking name, the cooking time and a weight of the food in a matrix configuration on a membrane keypad, i.e., a control panel.

Normally, the microcontroller which is connected with a key inputting section and a display unit receives a predetermined key signal from the key inputting section, performs a program responsive to a pertinent key signal, and displays the program on the display unit particularly in the case of the selection of the weight or cooking time.

In the case of the electronic-type microwave oven which adopts the microcontroller, an operating condition of the microcontroller comes to vary according to a weight unit and a commercial alternating current frequency depending on the export regions of the microwave ovens. In order to solve the above problem, the operating condition of the microwave oven is checked by using selection jumpers, i.e., electric wires, which are selectively connected to the ports of the microcontroller. Namely, the microcontroller senses and checks the weight unit and the commercial alternating current frequency in such a manner of connecting or disconnecting the selection jumpers to the voltage lines of the input ports of the microcontroller.

More particularly, when an electric power is provided to the microwave oven, the microcontroller performs the detection program according to the operating condition which is set preferentially. In the case where the selection jumpers are connected to the voltage lines, the microcontroller senses the weight unit and the commercial alternating current frequency as the first weight unit and the first commercial alternating current frequency, e.g., pound and 60 [Hz], respectively. On the contrary, in the case where the selection jumpers are disconnected from the voltage lines, the microcontroller senses the weight unit and the commercial alternating current frequency as the second weight unit and the second commercial alternating current frequency, e.g., gram and 50 [Hz], respectively.

As described above, when sensing the weight unit and the commercial alternating current frequency in response to whether or not the selection jumpers are connected by performing the detection program, the microcontroller sets a pertinent sensed flag and then sets a cooking mode for a general cooking program.

Also, the selection jumper type for a common use of the microcontroller has such problems that the input ports for the selection jumpers on the microcontroller are secured, that a space for installing the selection jumpers on a printed circuit board are necessitated, and that the cost and a number of the manufacturing processes are increased due to the use and the installation of the selection jumpers.

SUMMARY OF THE INVENTION

Therefore, it is a first object of the present invention to provide an operating condition setting type microwave oven for which, while a membrane keypad corresponding to a control panel of the microwave oven is being manufactured, in order for a control section to execute a key scanning operation, a contact sheet for confirming a set operating condition of the microwave oven is formed in a predetermined key, so that a user can confirm information according to the set operating condition of the microwave oven.

It is a second object of the present invention to provide a method for setting of an operating condition of the operating condition setting-type microwave oven described above.

It is a third object of the present invention to provide a method for detecting a set operating condition of the operating condition setting-type microwave oven described above.

In order to achieve the first object, the present invention provides an operating condition setting-type microwave oven wherein an operating condition thereof is set according to a detection of a predetermined operating condition and an operation thereof is then executed, the microwave oven comprising:

a key inputting section for setting at least one of the operating conditions of the microwave oven based on whether or not a contact sheet of at least one of a plurality of keypads is formed during a manufacturing process thereof; and a control section for detecting whether or not a key signal is inputted from the keypad for setting the operating condition of the key input section during an initial supply of an electric power to the microwave oven, for setting the operating condition of the microwave oven to a preset operating condition, and for controlling a cooking operation of the microwave oven according to the preset operating condition.

In order to achieve the invention of the second object, the present invention provides a method for setting an operating condition of a microwave oven which comprises a key inputting section including membrane keypads and a control section for controlling the microwave oven in response to a key signal generated from the membrane keypads, for setting the operating condition of the microwave oven to a predetermined operating condition based on whether or not the predetermined operating condition is detected, and for performing an operation thereof, the method comprising the steps of:

(I) setting at least one of the operating conditions of the microwave oven in response to whether or not a contact sheet of at least one of the membrane keypads is formed during a manufacturing process of the key inputting section;

(II) when an electric power is initially provided to the microwave oven after a manufacturing of the microwave oven is completed, detecting whether or not a key signal is generated from the membrane keypads for setting an operating condition of the key inputting section, and setting the operating condition of the microwave oven to a preset operating condition; and (III) controlling the operation of the microwave oven according to the preset operating condition thereof.

In order to achieve the third object, the present invention provides a method for detecting a predetermined operating condition of a microwave oven wherein, when a membrane keypad is manufactured, upper and lower contact sheets of a first keypad representing a predetermined frequency operating condition and of a second keypad representing a predetermined weight operating condition are connected or eliminated, and thereby detecting an operating condition of a microwave oven, the method comprising the steps of:

(i) when an electric power is supplied to the microwave oven to turn on a pertinent grid port of a display unit, detecting each of the grid ports in sequence, and checking whether or not either the first keypad or the second keypad is connected with the grid port of the display unit;

(ii) checking whether or not either the first keypad or the second keypad is connected with a key port of a control section when it is checked in step (i) that the first keypad or the second keypad is connected with the grid port of the display unit;

(iii) performing a normal cooking mode when it is checked in step (i) that the first keypad or the second keypad is not connected with the key port of the control section;

(iv) checking whether or not the first keypad or second keypad is a grid port for confirming a frequency when it is checked in step (ii) that the first keypad or second keypad is connected with the keyport of the control section;

(v) executing the normal cooking mode when it is checked in step (ii) that the first keypad or the second keypad is not connected with the key port of the control section;

(vi) when it is checked in step (iv) that the first keypad or second keypad is connected to the grid port, determining whether or not a key signal is inputted based on a connection or a disconnection of the contact sheet of the keypad, and setting a pertinent frequency flag; and (vii) when it is checked in step (iv) that the first keypad or second keypad is not connected to the grid port, determining whether or not a key signal is inputted based on a connection or a disconnection of the contact sheet of the keypad, and setting a pertinent weight flag.

In the method for setting an operating condition of an operating condition setting-type microwave oven according to the present invention, while a membrane keypad corresponding to a control panel of the microwave oven is being manufactured, more than at least one key pad for confirming a set operating condition of the microwave oven is formed at a predetermined key, and a control section can check the set operating condition of the microwave oven via a key port search, so that a reduced capability of the microcontroller, the security of a usable area on a printed circuit board, the reduction of the cost and of a number of the manufacturing processes, and the ease of the mass production management can be attained.

BRIEF DESCRIPTION OF THE DRAWINGS

The above objects and other advantages of the present invention will become more apparent by describing in detail a preferred embodiment thereof with reference to the attached drawings, in which.

DESCRIPTION OF THE PREFERRED EMBODIMENT

A description will be given below in detail with reference to accompanying drawings of a configuration and an operation of an operating condition setting-type microwave oven and method for setting and detecting an operating condition thereof according to an embodiment of the present invention.

Figure 1:
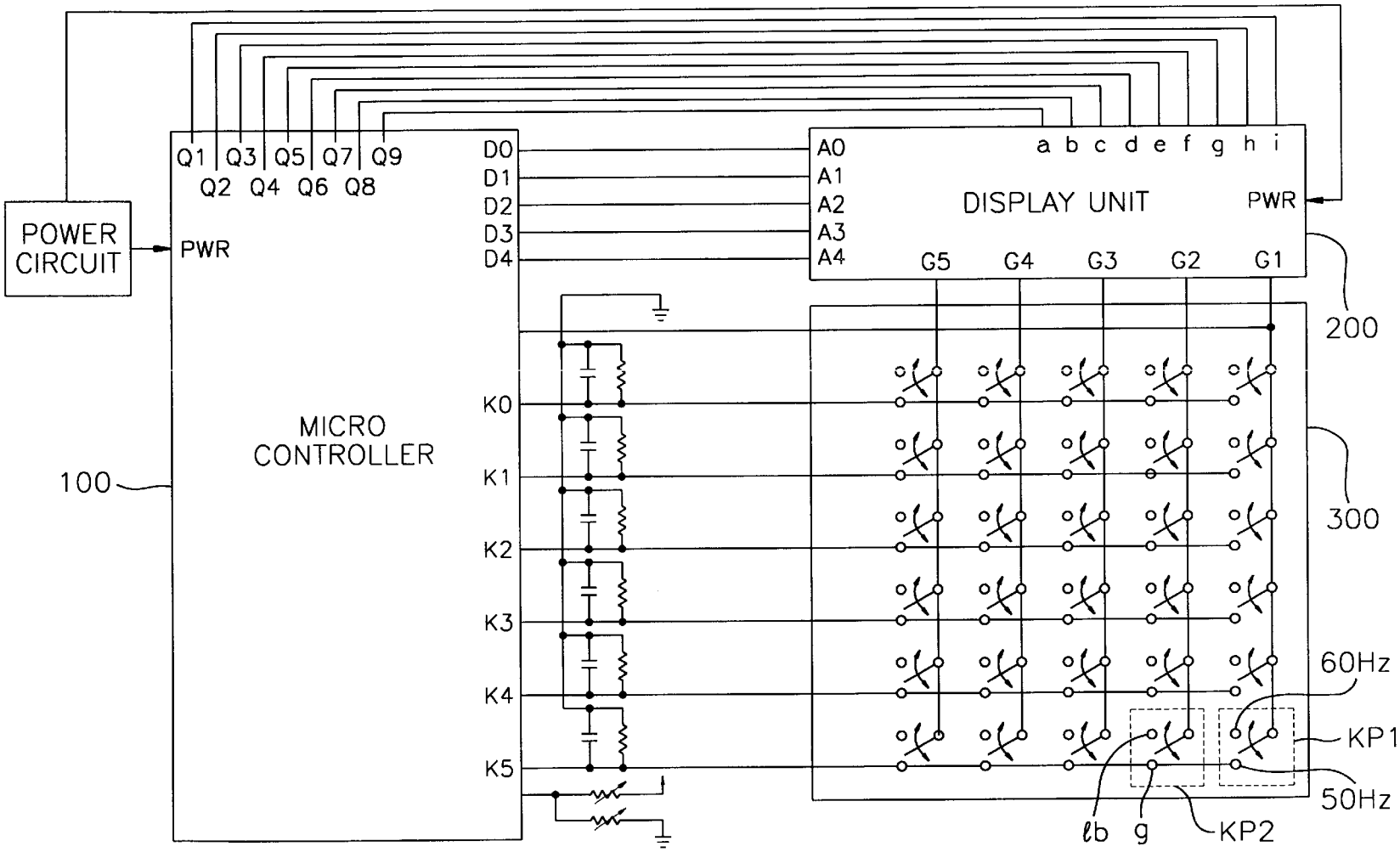
FIG. 1 is a sectional block diagram for showing a configuration of an operating condition setting-type microwave oven whose have two keypad's contact sheets are formed in a key matrix configuration, according to an embodiment of the present invention.

FIG. 1 is a sectional block diagram for showing a configuration of an operating condition setting type microwave oven whose have two keypad's contact sheets are formed in a key matrix configuration, according to an embodiment of the present invention.

Referring to FIG. 1, an operating condition setting-type microwave oven according to an embodiment of the present invention, includes a control section 100, display unit 200 and key inputting section 300.

The control section 100 normally consists of a microcontroller which comprises a control port for display units D0–D4 and the control port for keypads K0–K5, when an initial electric power is supplied to the microwave oven sets after the microwave oven sets are manufactured, detects whether or not a key signal generated from the keypad for setting an operating condition of the key inputting section 300, corresponding to a result when the above detecting sets an operating condition of microwave oven to a predetermined operating condition, executes the microwave oven sets according to the set operated condition.

The display unit 200 which is a vacuum fluorescent display(VFD) device using an excitation light phenomenon of a fluorescent material by a low velocity electron beam, comprises plurality anode ports A0–A4 and plurality grid ports G1–G5, display selection of a weight of the food, a cooking time, etc., interconnected with the microcontroller 100 and key inputting section 300.

The key inputting section 300 comprises the first keypad KP1 for confirming frequency and the second keypad KP2 for confirming of the weight according to the number of set operating conditions of the microwave oven.

More particularly, the first keypad KP1 and the second keypad KP2 are set to turn on or turn off by connecting or disconnecting an upper/lower contact sheet, while an inputting section 300 is being manufactured according to an operating condition of an export region of the microwave ovens.

In an embodiment of present invention, the first keypad KP1 and the second keypad KP2 operate in connection with a commercial alternating current frequency and a weight unit, respectively. In detail, the first keypad KP1 sets a 50 Hz flag by linking a number 5 keyport K5 of the microcontroller 100 to the first grid G1 of the display unit 200, and the second keypad KP2 sets a 60 [Hz] flag by linking a number 5 keyport K5 of the microcontroller 100 to the second grid G2 of the display unit 200.

When the first keypad KP1 and the second keypad KP2 are manufactured by disconnecting type of the number 5 keypad K5 of the microcontroller 100 to the first and second grid G1, G2 of the display unit 200 in a manufacturing of the key inputting section 300, it is obvious that the microcontroller 100 confirms [60 Hz] flag and pound-flag, respectively.

Figure 2:
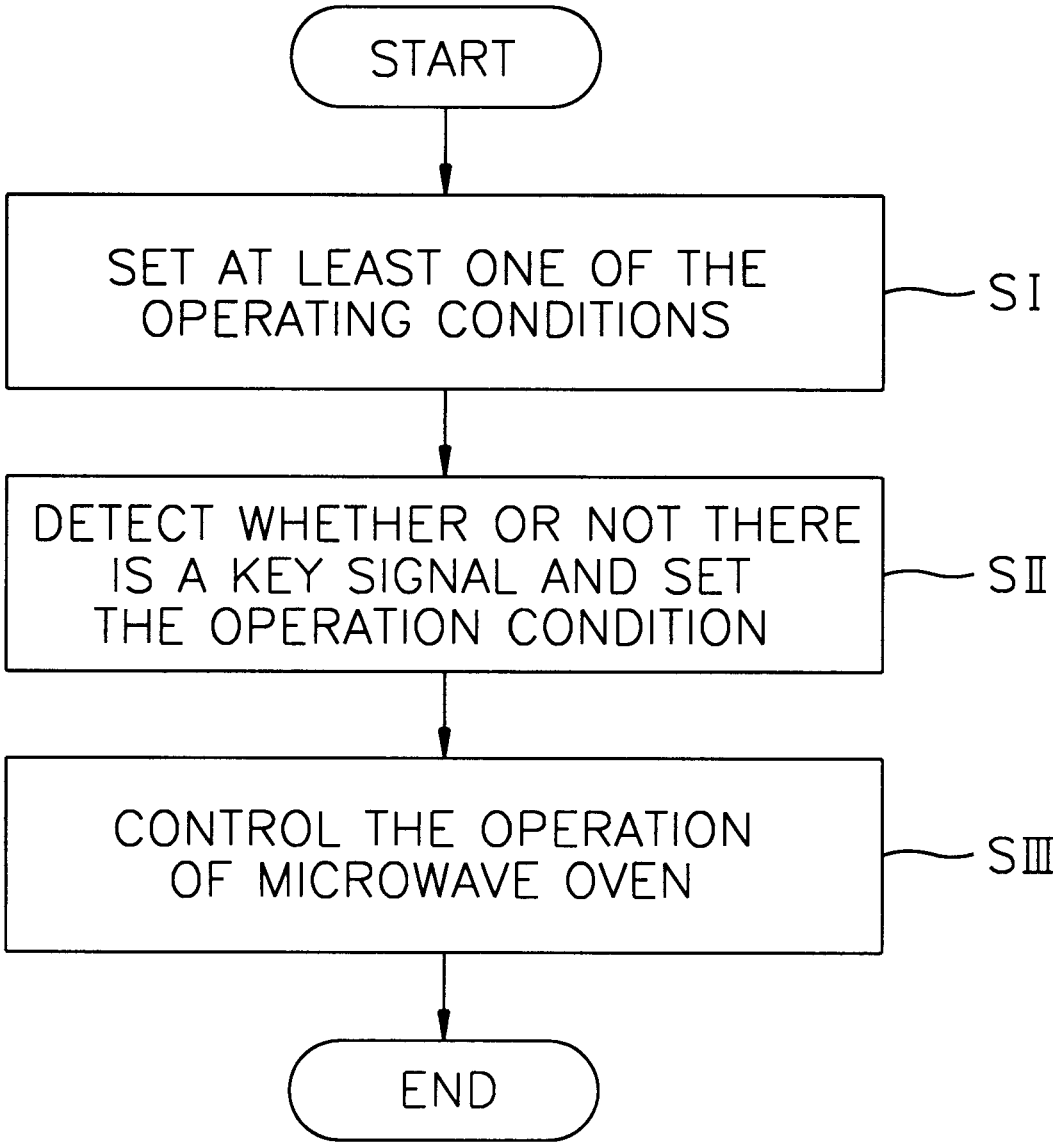
FIG. 2 is a flow chart illustrating a setting of an operating condition of a microwave oven in accordance with the present invention.

FIG. 2 is a flow chart illustrating a setting of an operating condition of a microwave oven in accordance with the present invention.

Referring to FIGS. 1 and 2, a method for setting an operating condition thereof is as follows.

In manufacturing step of the key inputting section 300, setting at least one of the operating conditions of microwave oven sets based on whether or not at least one of a keypad's contact sheets among the membrane keypads is formed when the key inputting section 300 is manufactured. At this time the operating condition is commercial alternating current frequency and weight unit (step SI).

The microcontroller 100 has an operating condition of microwave oven sets established to a predetermined operating condition based on whether or not a key signal generated by the membrane keypads for setting an operating condition of the key inputting section 300, when an initial electric power is supplied into the microwave oven sets after the microwave oven sets are manufactured (step SII).

After that, controlling the operation of the microwave ovens according to the preset operating condition thereof by microcontroller 100 (step SIII).

Figure 3:
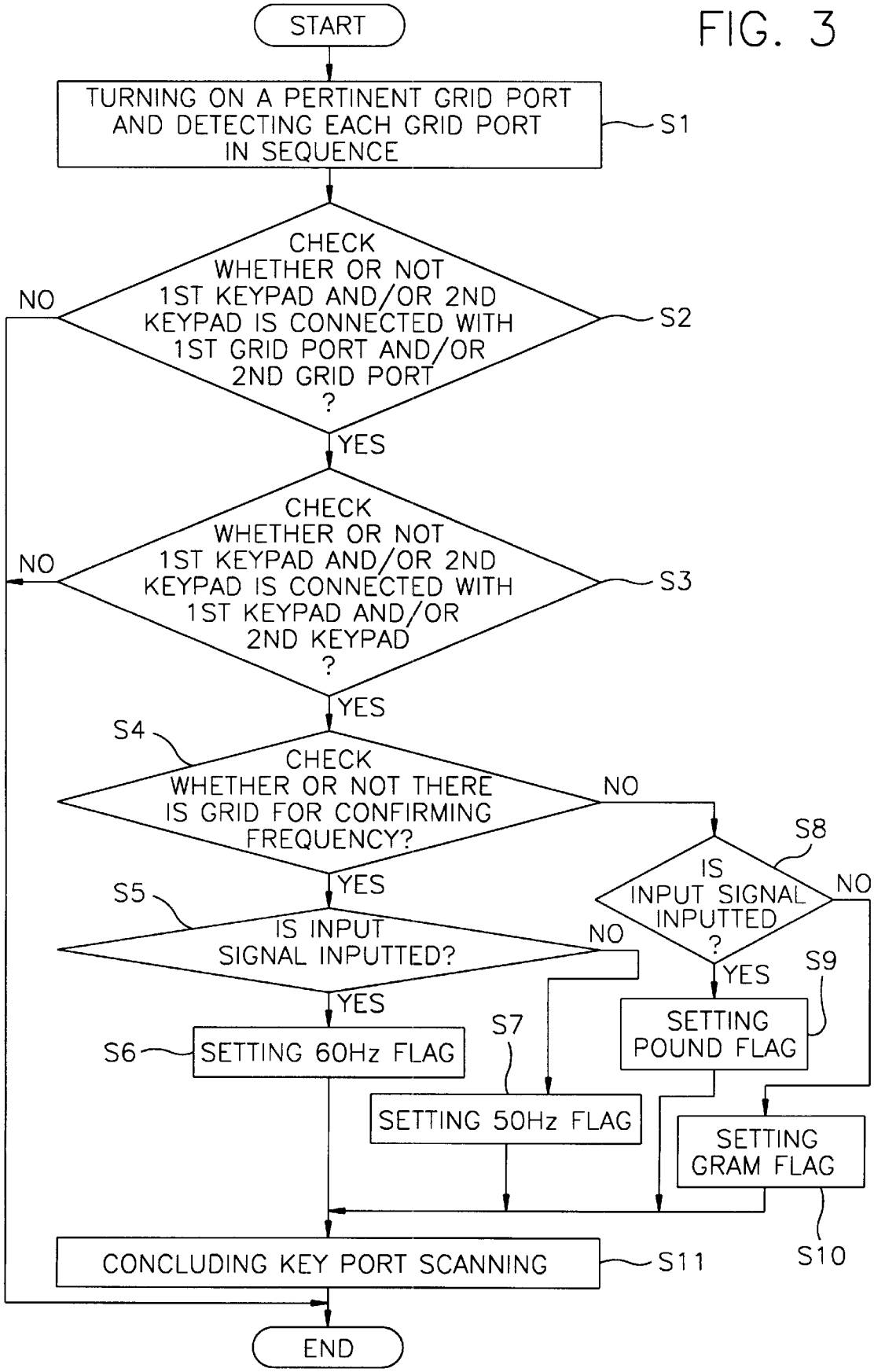
FIG. 3 is a flow chart illustrating a detection of a set operating condition of the microwave oven in accordance with a microcontroller of the present invention.

FIG. 3 is a flow chart illustrating a detection of a set operating condition of a microwave oven in accordance with a microcontroller of the present invention.

Referring to FIG. 1 and FIG. 3, a method for detecting a setting of an operating condition thereof is as follows.

When electric power is inputted to microwave oven sets, the microcontroller 100 provides a control signal to the display unit 200 by shifting each grid port G1 to G5 consecutively, and that detects a set operating condition by turning on each grid port of the display unit 200 (step S1).

The microcontroller 100 checks whether or not the first keypad KP1 and/or the second keypad KP2 are connected with the first grid port G1 and/or the second port G2 by providing control signals to display unit 200 through a control port D0 to D4 (step S2).

Subsequently, the microcontroller 100 checks whether or not either the first keypad KP1 or the second KP2 is connected with a number 5 key port K5 of the microcontroller 100 when it is checked in step S2 that the first keypad KP1 and the second keypad KP2 are connected with a grid port of the display unit 200. On the other hand, when it is checked in step S2 that the first keypad KP1 and the second keypad KP2 are disconnected with a grid port of the display unit 200, the microcontroller 100 concludes detecting operation of setting an operating condition (step S3).

After that, the microcontroller 100 checks whether or not either the first grid port G1 or the second grid port G2 is the grid port for confirming frequency when it is checked in step S3 that the first keypad KPl and the second keypad KP2 are connected with the number 5 key port K5 of microcontroller 100. On the other hand, when it is checked in step S3 that the first keypad KPl and the second keypad KP2 are disconnected with the number 5 key port K5 of microcontroller 100, the microcontroller 100 concludes detecting operation of setting an operating condition (step S4).

After that, the microcontroller 100 checks whether or not input signals are inputted in case the result of the checking in step S4 is a grid port for confirming frequency (step S5).

After that, the microcontroller 100 sets a [60 Hz] flag according to a connection where an upper contact sheet is connected to a lower contact sheet when it is checked in step S5 that the input signal is inputted (step S6), sets a [50 Hz] flag according to a disconnection where an upper contact sheet is disconnected to a lower contact sheet when it is checked in step S5 that the input signal is not inputted (step S7), and concludes a key port scanning operation (step S11).

Also, the microcontroller 100 checks whether or not the grid port is a grid port for confirming frequency G1, after the above checking result is checked that the grid port is not a grid port for confirming frequency G1, regards as grid port for confirming weight unit G2, and then checks whether or not an input signal is inputted (step S8).

The microcontroller 100 sets a pound-flag according to a connection whose an upper contact sheet is connected to a lower contact sheet when it is checked in step S8 that the input signal is inputted (step S9), sets a gram-flag according to a disconnection where an upper contact sheet is disconnected to a lower contact sheet when it is checked in step S8 that the input signal is not inputted (step S10), and concludes a key port scanning operation (step S11).

According to an embodiment of the present invention as described above, because extra keys, which are currently unused among a plurality of keys on the membrane keypad, can be utilized, the increase of the key ports of the microcontroller does not occur. Further, even though a number of the key ports of the microcontroller increases due to no extra keys among the plurality of keys on the membrane keypad, because the configuration of the keys is a matrix structure, the increase of a number of the ports of the microcontroller can lead to the management of a plurality of set operating conditions.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An operating condition setting-type microwave oven wherein an operating condition thereof is set according to a detection of a predetermined operating condition and an operation thereof is then executed, said microwave oven comprising:

a key inputting means for setting operating conditions of the microwave oven with a first keypad by which a frequency of an input power is selected and a second keypad by which a weight unit is selected;

a displaying means, connected with the key inputting means, for displaying the operating conditions set by the first and second keypads; and a control means for detecting the operating conditions by checking whether the displaying means and each of the first and second keypads form closed loops, for setting the detected operating conditions as preset operating conditions of the microwave oven, and for controlling a cooking operation of the microwave oven according to the preset operating conditions.

2. The operating condition setting-type microwave oven as claimed in claim 1, wherein the first keypad is a membrane keypad for selecting either 60 Hz or 50 Hz, and the second keypad is a membrane keypad for selecting either a pound unit or a kilogram unit.

3. The operating condition setting-type microwave oven as claimed in claim 1, wherein in order to check the closed loops, the control means scans ports of the displaying means connected with the first and second keypads, applies a first control signal to a first port of the displaying means connected with the first keypad and a second control signal to a second port of the displaying means connected with the second keypad, and checks whether the first control signal comes back through a first closed loop formed with the displaying means and the first keypad and whether the second control signal comes back through the closed loop formed with the displaying means and the first keypad.

* * * * *